US011319859B2

(12) United States Patent
Zhang et al.

(10) Patent No.: US 11,319,859 B2
(45) Date of Patent: May 3, 2022

(54) NOISE ATTENUATING EXHAUST TAIL PIPE

(71) Applicant: Ford Global Technologies, LLC, Dearborn, MI (US)

(72) Inventors: Yahong Zhang, Canton, MI (US); Erich J. Nowka, Ann Arbor, MI (US); Eric Hupfel, Harrison Township, MI (US); Elisangela Po Previte, Wolverine Lake, MI (US); Ian McLaughlin, Bloomfield Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 419 days.

(21) Appl. No.: 16/426,919

(22) Filed: May 30, 2019

(65) Prior Publication Data

US 2020/0378294 A1 Dec. 3, 2020

(51) Int. Cl.

| | |
|---|---|
| ***F01N 13/20*** | (2010.01) |
| ***F01N 13/08*** | (2010.01) |
| ***F01N 1/08*** | (2006.01) |

(52) U.S. Cl.

CPC ..... *F01N 13/082* (2013.01); *F01N 1/085* (2013.01); *F01N 13/20* (2013.01)

(58) Field of Classification Search

CPC ..... F01N 13/082; F01N 13/08; F01N 13/20; F01N 1/085; F01N 2470/00; F01N 2470/10

See application file for complete search history.

(56) References Cited

U.S. PATENT DOCUMENTS

D165,985 S * 2/1952 Koonter ..... D12/194
2,858,853 A * 11/1958 Lyon ..... F01N 13/20 239/601
2,992,035 A * 7/1961 Tell ..... F01N 13/20 293/113
3,174,282 A * 3/1965 Harrison ..... F02K 1/48 239/265.17
3,561,562 A * 2/1971 Ignoffo ..... F01N 13/082 181/247
3,743,185 A * 7/1973 FFowces-Williams ..... F02K 1/42 239/265.27
3,968,853 A * 7/1976 Hoch ..... F02K 1/44 181/213

(Continued)

FOREIGN PATENT DOCUMENTS

DE 10025121 A1 * 12/2001 ..... F01N 13/1811
DE 102010045551 A1 5/2012

(Continued)

OTHER PUBLICATIONS

Herhusky, N. et al., "Methods and Systems for Engine Idle Stop," U.S. Appl. No. 16/440,514, filed Jun. 13, 2019, 40 pages.

*Primary Examiner* — Edgardo San Martin
(74) *Attorney, Agent, or Firm* — Geoffrey Brumbaugh; McCoy Russell LLP

(57) ABSTRACT

Methods and systems are provided for an exhaust system of a vehicle. In one example, the exhaust system includes an exhaust tail pipe with an asymmetric outlet. The asymmetric outlet of the tail pipe may flare outwards, away from a central axis of the tail pipe, circumferentially surrounded by a housing with a geometry matching a geometry of the asymmetric outlet.

20 Claims, 7 Drawing Sheets

(56) References Cited

U.S. PATENT DOCUMENTS 4,066,214 A * 1/1978 Johnson ..... F02K 1/386 244/53 R
4,566,270 A * 1/1986 Ballard ..... F02K 1/825 60/264
4,580,657 A * 4/1986 Schmeichel ..... F01N 1/08 181/255
4,696,368 A * 9/1987 Hummel ..... F01N 13/082 180/287
5,058,703 A * 10/1991 Ealba ..... F01N 3/2892 181/228
5,110,560 A * 5/1992 Presz, Jr. ..... F15D 1/001 422/176
5,230,656 A * 7/1993 Paterson ..... F24F 13/26 239/590.5
5,962,821 A 10/1999 Iannetti
6,283,162 B1 9/2001 Butler
7,312,964 B2 12/2007 Tchernobrivets
7,316,109 B2 * 1/2008 Clerc ..... F01N 3/021 60/311
7,604,092 B2 * 10/2009 Fritz ..... F01N 13/082 180/296
8,393,423 B2 3/2013 Gwozdek et al.
8,863,870 B2 10/2014 Gwozdek et al.
9,284,868 B2 3/2016 Pommerer et al.
9,346,350 B2 5/2016 Nowka et al.
9,536,040 B2 1/2017 Zhang et al.
D787,400 S * 5/2017 Wolff ..... D12/194
9,670,821 B2 6/2017 Nowka et al.
10,801,390 B2 * 10/2020 Burns ..... F01N 13/1855
D911,897 S * 3/2021 Zhang ..... D12/194
2010/0320964 A1 12/2010 Lathrop et al.
2012/0145268 A1 * 6/2012 Clarke ..... F01N 13/082 138/40
2013/0112371 A1 5/2013 Koo et al.
2015/0192632 A1 7/2015 Crosman, III et al.
2018/0100468 A1 * 4/2018 Sutterfield ..... F01D 25/30

FOREIGN PATENT DOCUMENTS

DE 102017009734 A1 * 4/2018 ..... F01N 1/00
EP 1428743 A2 6/2004
GB 567751 A * 3/1945 ..... F01N 1/16

* cited by examiner

NOISE ATTENUATING EXHAUST TAIL PIPE

FIELD

The present description relates generally to an engine exhaust system.

BACKGROUND/SUMMARY

An exhaust system of a vehicle may comprise a set of components that impact engine performance as well as an environment surrounding and within the vehicle. For example, venting of exhaust gases through the exhaust system circumvents generation of backpressure at the engine's combustion chambers, assisting in maintaining a high efficiency of the engine.

Aftertreatment devices in the exhaust system may remove pollutants from the exhaust gases before the gases are released to the atmosphere, thereby reducing emission of substances such as carbon monoxide, hydrocarbons, and nitrous oxides.

The flow of high velocity exhaust gases through an exhaust pipe of the exhaust system, however, may result in generation of undesirable, high decibel noise that is audible from both an exterior and interior of the vehicle. The noise may be sufficiently loud as to inhibit conversations between vehicle occupants and cause discomfort to the occupants, particularly during prolonged exposure to the noise during vehicle operation.

Attempts to address exhaust pipe noise include adding a sound absorbing material to the exhaust system. One example approach is shown by Ianetti in U.S. Pat. No. 5,962,821. Therein, a noise reduction apparatus is used in an exhaust system of an engine. The apparatus absorbs acoustical energy from exhaust gases flowing through the exhaust system by passing the gases through a housing disposed with a plurality of sound absorbing layers. The apparatus may further include a cone-shaped element inside the housing that compresses the gas flow to further reduce noise. Noise generated at the exhaust system is thus suppressed without restricting flow through the exhaust system and creating backpressure at the engine.

However, the inventors herein have recognized potential issues with such systems. As one example, the apparatus has a housing that may be cumbersome and occupy an undesirable volume of space in an undercarriage of the vehicle. In addition, the plurality of sound absorbing layers arranged inside the housing of the apparatus may impose additional weight to the vehicle and result in increased fuel consumption due to the increased weight. A fuel efficiency of the vehicle is thereby adversely affected due to presence of the noise reduction apparatus.

In one example, the issues described above may be at least partially addressed by an asymmetric exhaust tail pipe outlet, including a first flared extension, sloping outwards and away from a central axis of the exhaust tail pipe outlet from a first end to a second end of the outlet, sharing an inner surface with surrounding portions of the exhaust tail pipe outlet, and a second flared extension, opposite of the first flared extension, sloping outwards and away from the central axis from the first end to the second end to a lesser extent than the first flared extension and also sharing the inner surface of the exhaust tail pipe outlet. In this way, exhaust system noise is reduced without incurring additional vehicle weight.

As one example, the tail pipe of the exhaust system is modified to include an expanded asymmetric outlet shape.

The expanded outlet decreases flow velocity of exhaust gases as the gases pass through the outlet, resulting in reduced noise generation at the tail pipe. By modifying a geometry of the tail pipe outlet, high decibel acoustic waves are attenuated without additional components that add weight to a vehicle or occupy an undesirable amount of space. Engine pressure is not affected by implementation of the tail pipe outlet and more comfortable riding experience is provided for vehicle occupants.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-8 are shown approximately to scale

DETAILED DESCRIPTION

Figure 1:
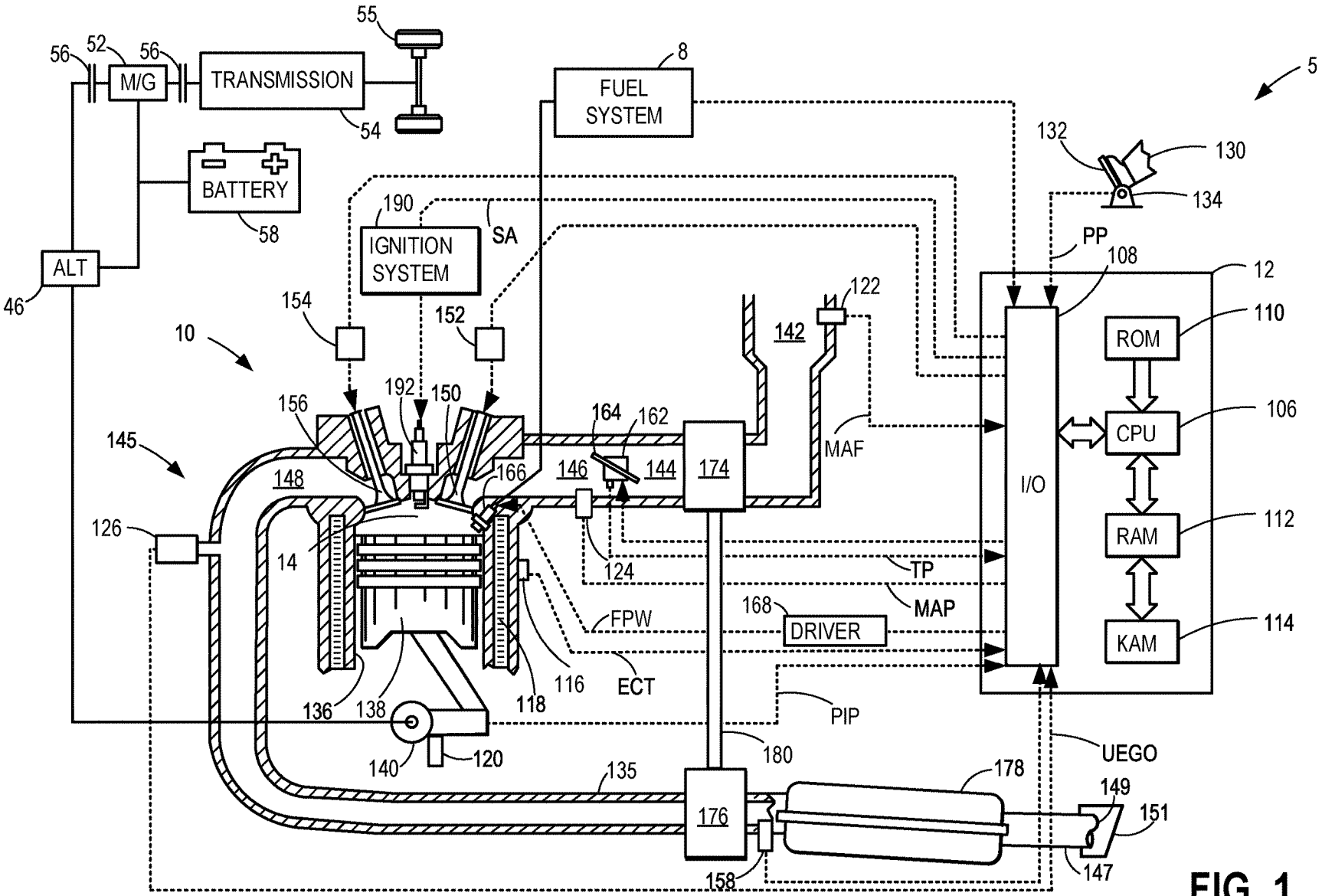
FIG. 1 shows a schematic diagram of an engine system, including an exhaust system equipped with an asymmetric tail pipe outlet.
Figure 2:
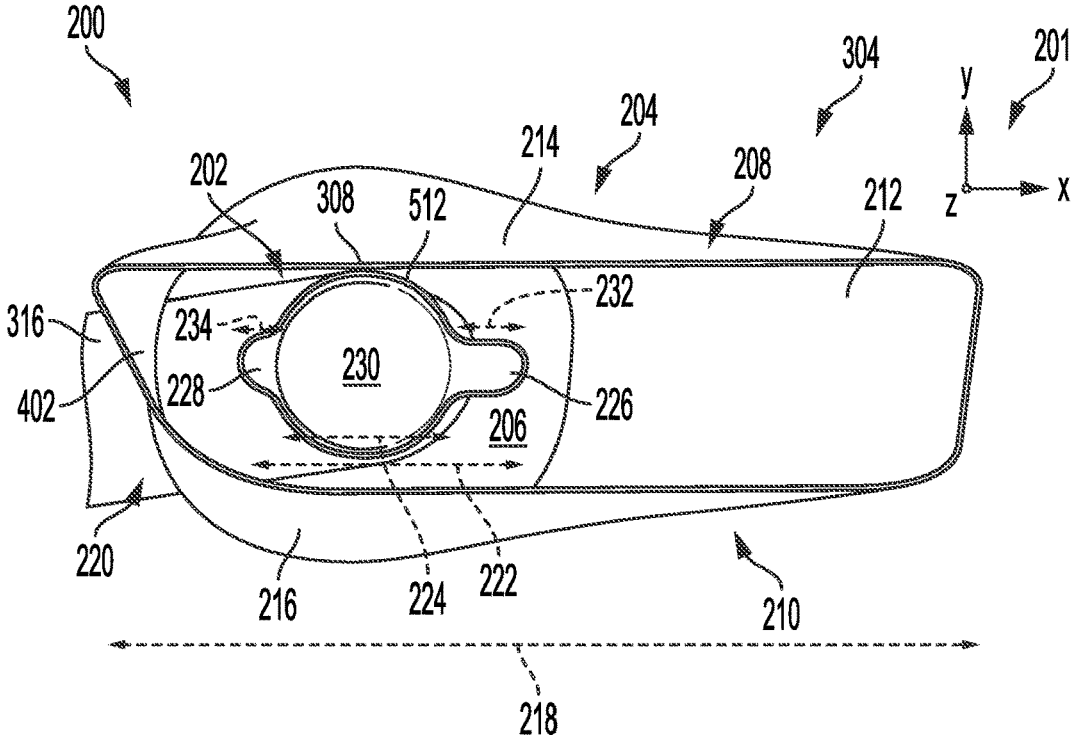
FIG. 2 shows a first example of an asymmetric tail pipe outlet framed within a bezel from a vehicle rear view.
Figure 3:
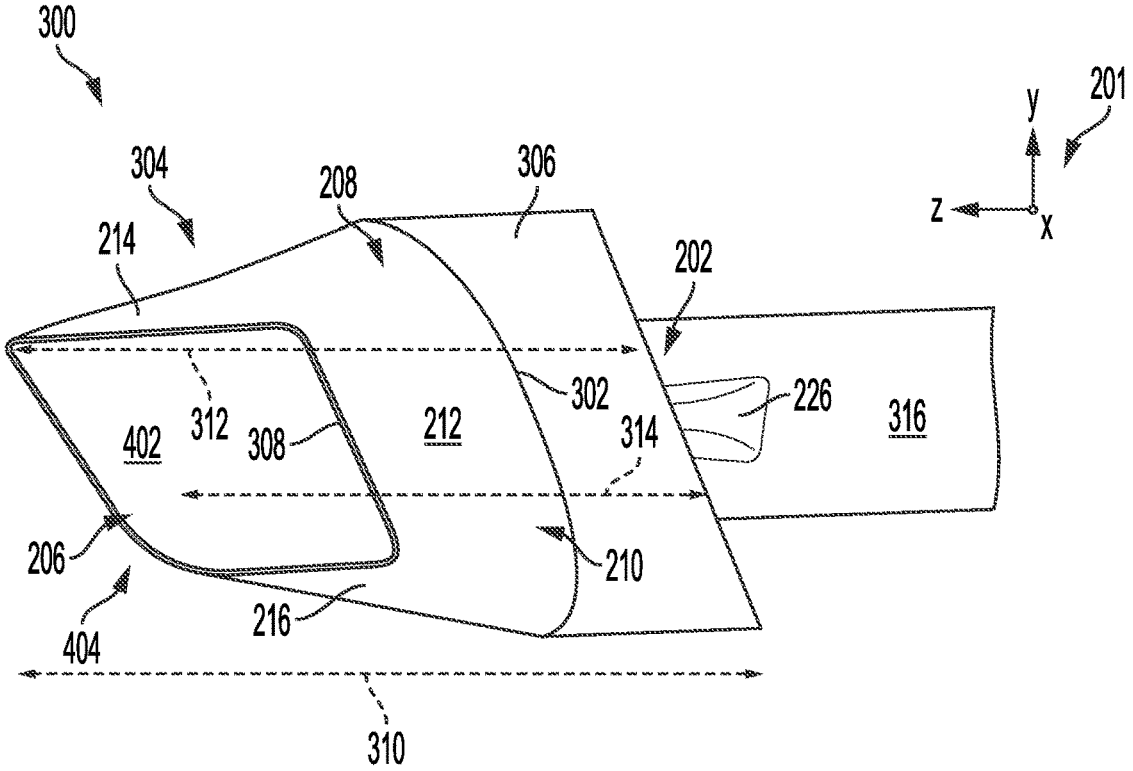
FIG. 3 shows the asymmetric tail pipe outlet and the bezel from a vehicle right side view.
Figure 4:
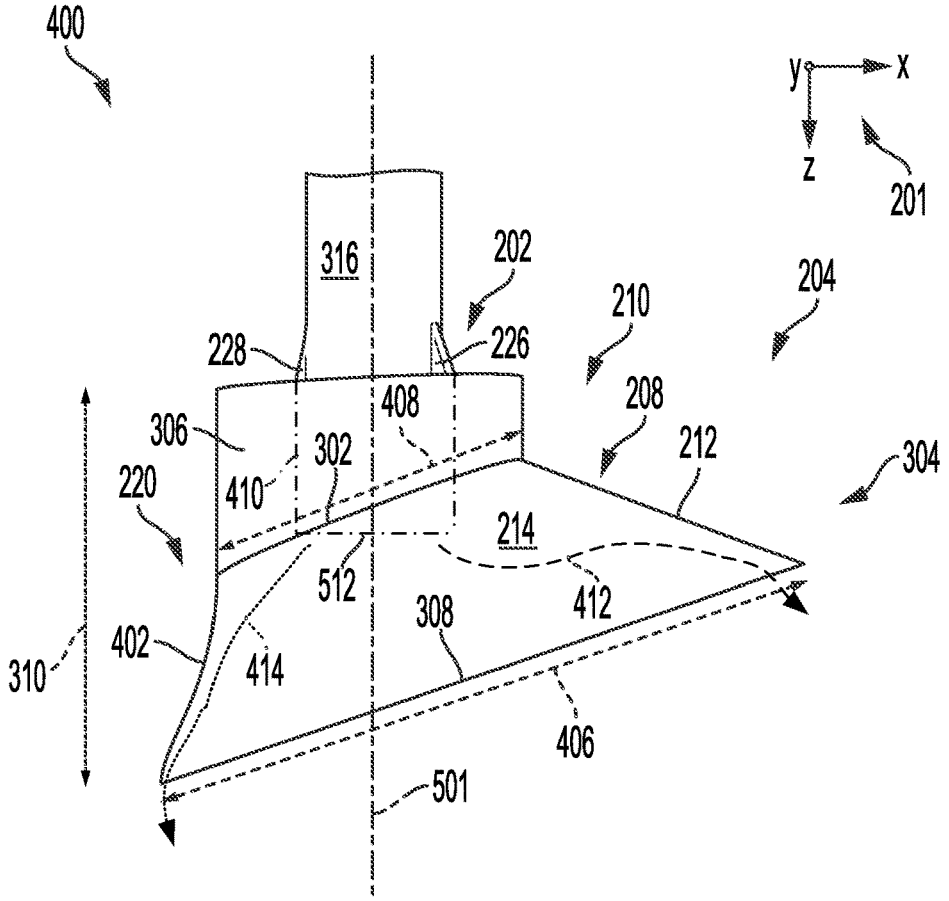
FIG. 4 shows the asymmetric tail pipe outlet and the bezel from a top view.
Figure 5:
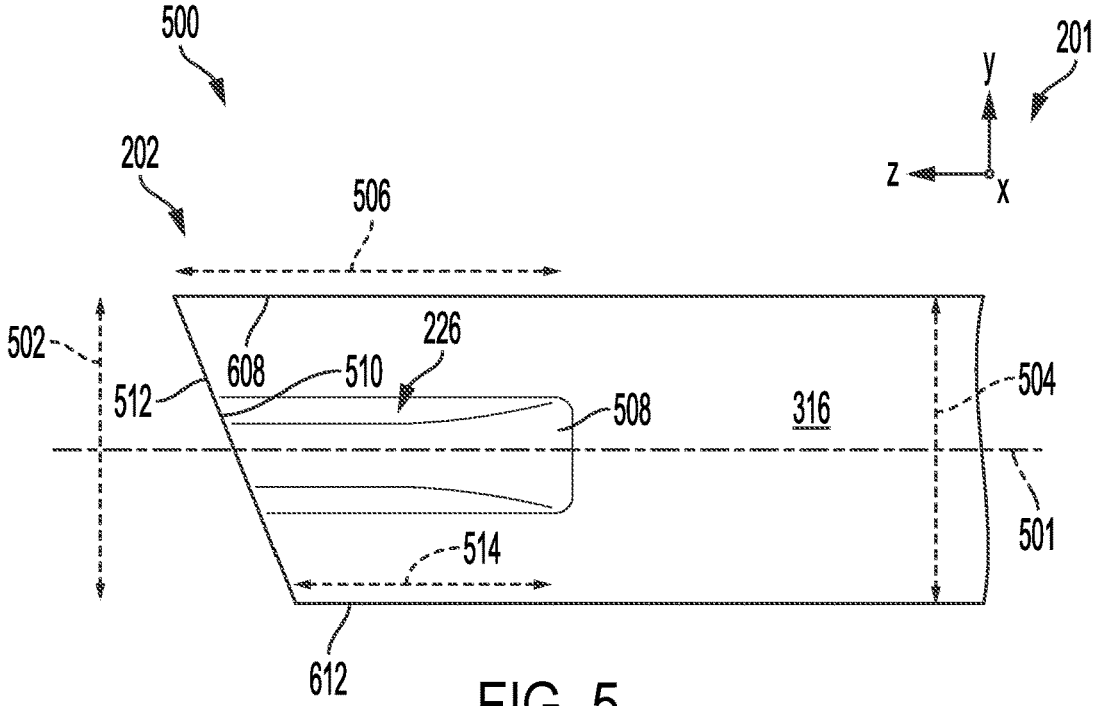
FIG. 5 shows the asymmetric tail pipe outlet from a profile view without the bezel.
Figure 6:
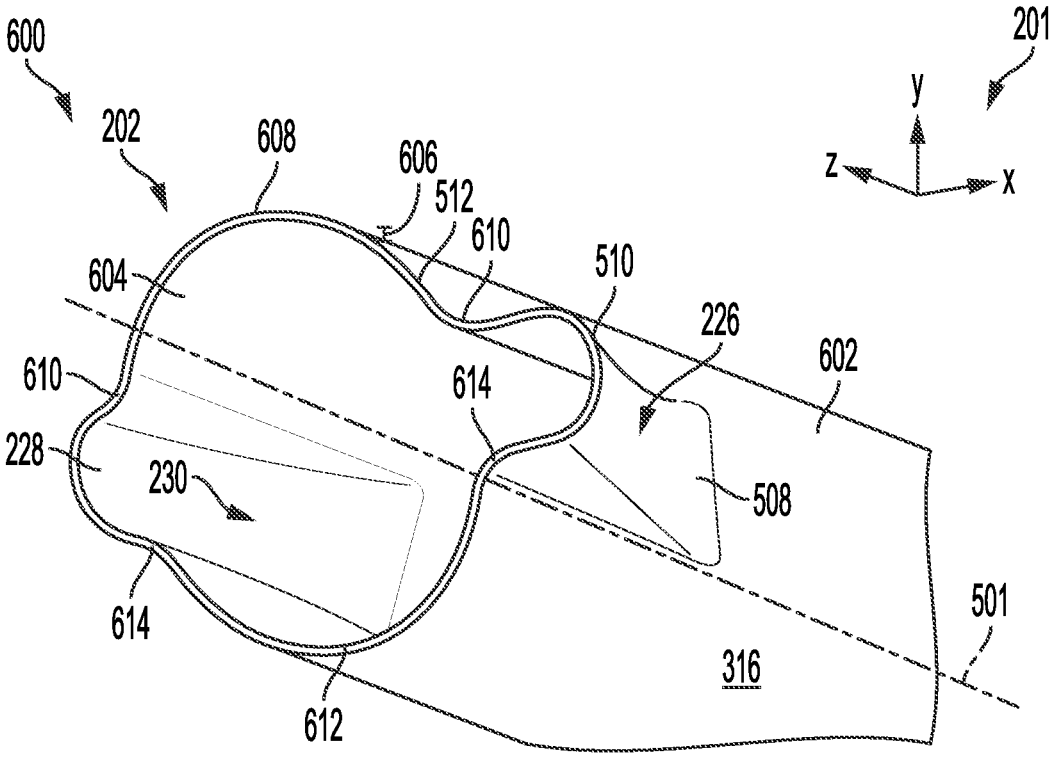
FIG. 6 shows the asymmetric tail pipe outlet from a perspective view.
Figure 7:
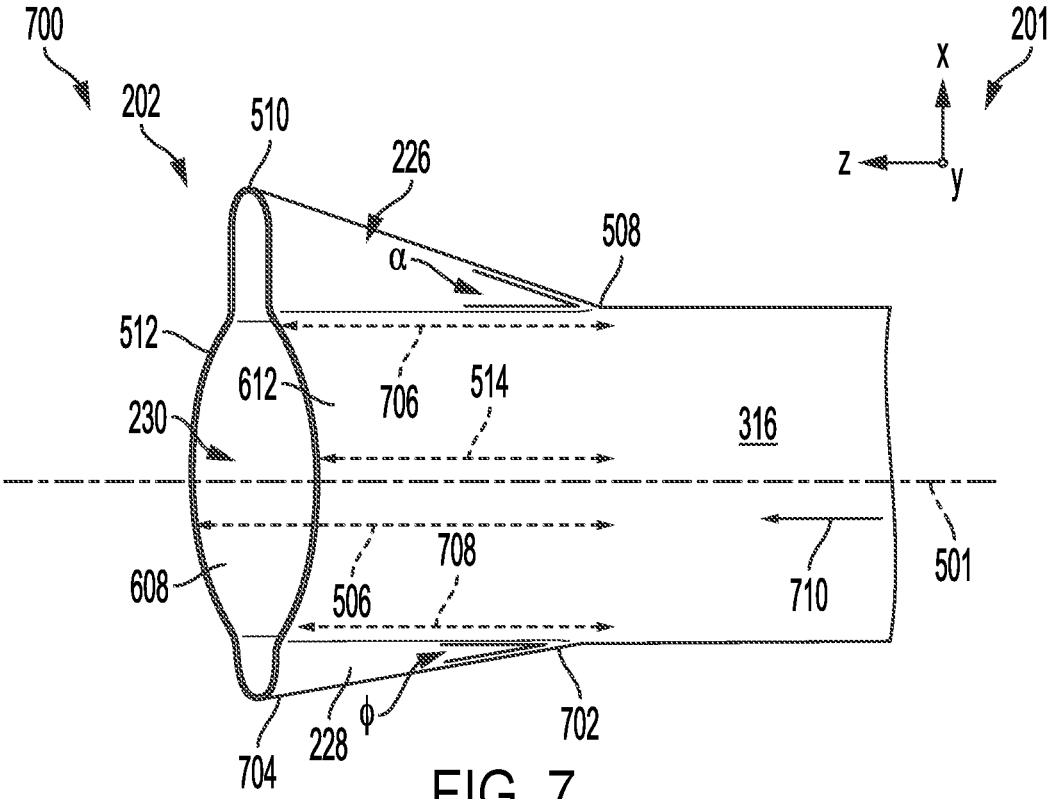
FIG. 7 shows the asymmetric tail pipe outlet from a bottom view.
Figure 8:
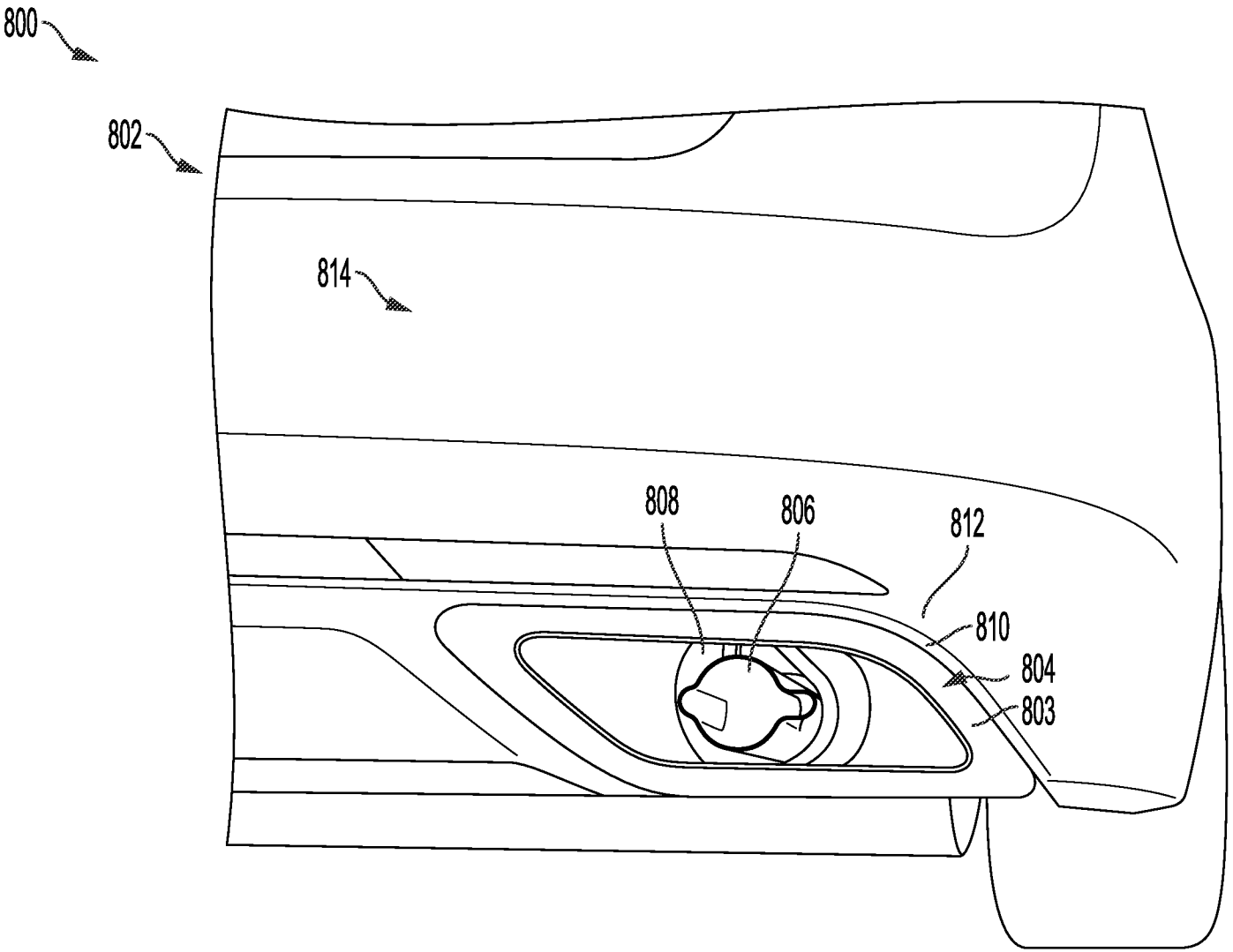
FIG. 8 shows a second example of an asymmetric tail pipe outlet framed within a bezel and installed in a rear bumper of a vehicle.

The following description relates to an exhaust tail pipe for an exhaust system of a vehicle. The exhaust system is configured to vent exhaust gases generated in combustion chambers of the vehicle engine, from the combustion chambers to the surrounding atmosphere to alleviate backpressure in the chambers. An example of an engine system, including an exhaust system coupled to a combustion chamber of the engine system, is shown in FIG. 1. The exhaust system may be adapted with a tail pipe outlet that has an asymmetric geometry, where a cross-sectional area of the outlet increases as the outlet flares outward, resulting in a decrease in flow velocity of exhaust gases exiting the tail pipe. The decrease in flow velocity reduces noises generated by high velocity gases passing through the tail pipe. The outlet of the tail pipe may be framed within a housing that couples to an outer body panel of the vehicle. An example of an asymmetric tail pipe outlet positioned within the housing is depicted in FIGS. 2-4, illustrating the outlet in a front view, a profile view, and a top view. A geometry of the asymmetric tail pipe outlet is shown with greater clarity with the housing omitted in FIGS. 5-7, depicting a profile view, a perspective view, and a bottom view of the asymmetric tail pipe outlet. An arrangement of an asymmetric tail pipe in a vehicle is shown in FIG. 8, including a rear bumper, a bezel, and the asymmetric tail pipe positioned within the bezel. A comparison of acoustic power produced at a circular tail pipe outlet versus an asymmetric tail pipe outlet is shown in contour plots for the two tail pipe configurations in FIGS. 10 and 11.

FIGS. 2-8 show example configurations with relative positioning of the various components. If shown directly contacting each other, or directly coupled, then such elements may be referred to as directly contacting or directly coupled, respectively, at least in one example.

Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In order to suppress high frequency noises emanating from an exhaust system due to high velocity gas flow, a muffler may be added to an exhaust tail pipe of the exhaust system. The muffler may have a housing enclosing a sound absorbing material and may dampen exhaust sounds during engine operation. However, incorporation of the muffler may add undesirable weight to the vehicle as well as occupy space that may otherwise be utilized by other vehicle components.

By configuring the tail pipe with an outlet that flares outwards, increasing a cross-sectional area of the outlet relative to regions of the tail pipe upstream of the outlet, the tail pipe outlet may suppress exhaust noises, with a similar effect as the muffler, by expanding a flow area of the tail pipe and decreasing flow velocity. As a result, the muffler may be precluded or at least reduced in size.

The exhaust tail pipe may direct exhaust gases out of the exhaust system and through an opening in a body panel of the vehicle, such as a rear fascia. The rear fascia may be included as a decorative feature in close proximity to the tail pipe and thereby subjected to exhaust soot and/or condensate deposits during vehicle operation, increasing a likelihood of customer dissatisfaction in addition to loud noises generated in the exhaust tail pipe.

In some examples, the rear fascia may be below a rear bumper of the vehicle, biased towards one side of the vehicle, e.g., not centrally disposed. A shield may be coupled to the edges of the opening and include a bezel framing the tail pipe outlet. The bezel may have an asymmetric geometry to accommodate the biased positioning of the opening. The asymmetric shape of the bezel may allow the bezel to blend into a contour of the rear bumper, providing a desirable aesthetic of the bumper by hiding edges of the opening and surrounding the tail pipe outlet without coming in contact with the tail pipe outlet, e.g., the shield does not provide structural support to the outlet.

The bezel may be shaped to reduce deposition of materials entrained by the exhaust gas flow, such as soot, onto the outer surface of the rear fascia and mitigate resulting discoloration (due to soot and high exhaust gas temperatures) of the outer surface. The expanding tail pipe outlet may be similarly asymmetric to match the geometry of the bezel, thereby producing an exhaust plume with a geometry defined by the tail pipe outlet that reduces impingement of exhaust gases on the bezel. Thus, discoloration of the bezel is reduced.

In one example, the tail pipe outlet may be shaped with a first flared extension on one side of the outlet and a second flared extension on an opposite side from the first flared extension. The first flared extensions may merge seamlessly and uninterruptedly with walls of the tail pipe outlet, sharing a continuous inner surface so that exhaust gases flowing out of the exhaust pipe contact inner surfaces of the flared extensions.

Dimensions of the flared extensions may match the geometry of the bezel. For example, if the bezel has an elongated right side, one of the flared extensions positioned on the right side of the tail pipe outlet may also be elongated compared to the oppositely arranged flared extension. The asymmetric shape of the tail pipe outlet creates an asymmetrically shaped plume of exhaust gases exiting the exhaust tail pipe. A likelihood of the exhaust gas impinging on a concentrated area of the bezel is thereby decreased due to a matching of the asymmetric tail pipe to the geometry of the bezel. In this way, the asymmetric tail pipe outlet may reduce noises generated in the exhaust pipe by diffusing gas flow and have a shape that decreases degradation of the bezel while providing a complementary aesthetic. An arrangement of the outlet in an engine system is introduced in FIG. 1 and specific details as to the geometry, configuration of the tail pipe outlet relative to the bezel and effects of the outlet on sound emission are elaborated in FIGS. 2-8.

Turning now to the figures, FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine or an electric vehicle with only an electric machine(s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust system 145 is coupled to cylinder 14 via a poppet valve 156. The exhaust system includes an exhaust manifold 148, an emission control device 178, and exhaust tail pipe 147. Exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO. Emission control device 178 may be a three-way catalyst, a NOx trap, various other emission control devices, or combinations thereof. In the example of FIG. 1, emission control device 178 is a three-way catalyst.

The exhaust tail pipe 147 is positioned downstream of and coupled to emission control device 178 delivering exhaust gases that have been treated by emission control device 178 to the surrounding atmosphere. In one example, the exhaust tail pipe 147 may have an asymmetric outlet 149, varying a cross-sectional area, and thereby inner volume, of the exhaust tail pipe 147 at the asymmetric outlet 149. The change in inner volume of the exhaust tail pipe 147 affects a velocity of gases travelling through the asymmetric outlet 149 as well as generation of audible acoustic waves as the gases contact inner walls of the exhaust tail pipe 147. The asymmetric outlet 149 may be surrounded by a housing or shield 151 where the asymmetric outlet 149 is spaced away and not in contact with inner surface of the shield 151. The asymmetric outlet 149 is adapted with a geometry to enable coupling to supporting structures in an undercarriage of the vehicle 5 so that the asymmetric outlet 149 is suspended and extends through an opening of an exterior panel of the vehicle 5 that is framed by the shield 151. Further details of the asymmetric tail pipe outlet 149 are described below, with reference to FIGS. 2-8.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of alcohol and water, a mixture of water and methanol, a mixture of alcohols, etc. In still another example, both fuels may be alcohol blends with varying alcohol compositions, or the first and second fuels may differ in other fuel qualities, such as a difference in temperature, viscosity, octane number, etc. Moreover, fuel characteristics of one or both fuel tanks may vary frequently, for example, due to day to day variations in tank refilling.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 135; a profile ignition pickup signal (PIP) from a Hall effect sensor 120 (or other type) coupled to crankshaft 140; throttle position (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

Controller 12 receives signals from the various sensors of FIG. 1 and employs the various actuators of FIG. 1 to adjust engine operation based on the received signals and instructions stored on a memory of the controller. For example, the controller may estimate the AFR of the exhaust gas based on a signal from the exhaust gas sensor 126 and used the inferred AFR to adjust a fuel injection rate at the cylinder 14.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

An exhaust system, such as the exhaust system 145 of FIG. 1, may directly impact engine performance, vehicle fuel efficiency, and release of combustion byproducts to the atmosphere. In order to maintain a desirable torque output and fuel consumption of an engine, the exhaust system may be configured to allow uninhibited flow of high pressure and high velocity exhaust gases therethrough. However, channeling of the exhaust gases through a relatively narrow passageway, e.g., the tail pipe 147 of FIG. 1, may result in generation of acoustic waves that may be disruptive to both vehicle occupants and bystanders external to the vehicle. Over time, exposure to high frequency and high amplitude acoustic waves may cause discomfort to individuals within close proximity of the vehicle.

To address the issue of undesirable noise production at the exhaust system of the vehicle, the tail pipe of the exhaust system may have an asymmetric, flared outlet that widens a cross-sectional area of the tail pipe at the outlet. The asymmetric outlet may be disposed at a most downstream end of the tail pipe. An example of an asymmetric tail pipe outlet 202 (hereafter, asymmetric outlet 202) is shown in FIGS. 2, 3 and 4, from a vehicle rear view 200, a vehicle right side view 300, and a top view 400, respectively, and will be discussed collectively. In one example, the asymmetric outlet 202 may be the asymmetric outlet 149 of the tail pipe 147 of FIG. 1 and the asymmetric outlet 202 may be included in an exhaust system of a vehicle, such as the vehicle 5 of FIG. 1. A set of reference axes 201 is provided for comparison between views, indicating a y-axis, an x-axis, and a z-axis. In some examples, the y-axis may be parallel with a direction of gravity, e.g., a vertical direction, the x-axis parallel with a horizontal direction, with the z-axis perpendicular to both the y-axis and the x-axis. It will be appreciated that while the asymmetric outlet 202 and the shield 204 (also, an exhaust outlet assembly) are shown in FIGS. 2-8 with a consistent orientation relative to the set of reference axes 201, the exhaust outlet assembly may be disposed in a vehicle in a variety of orientations without departing from the scope of the present disclosure. For example, the exhaust outlet assembly may be rotated 90 degrees, 180 degrees, or any angle between 0-360 degrees relative to the positioning shown in FIGS. 2-8. Furthermore, the exhaust outlet assembly may be adapted to extend through a different portion of the vehicle outer panels than shown in FIG. 8.

The asymmetric outlet 202 may be least partially circumferentially surrounded by a housing, or enclosure, or a shield 204. While the shield 204 may be defined as a housing, the shield 204 is different from a housing used to enclose sound absorbing materials, e.g., a housing of a muffler. Instead the shield 204 may be used to frame the asymmetric outlet 202 within an outer panel of a vehicle and does not directly contact a tail pipe upstream of the asymmetric outlet 202 or house any sound absorbing layers.

In some examples, particularly in performance vehicles, the tail pipe of the exhaust system may be routed along a vehicle undercarriage to emerge through a vehicle body kit. For example, the tail pipe outlet may be configured to protrude through an opening in a side skirt or a rear fascia of the body kit, as shown in FIG. 8 and described below. The opening in the body kit may be framed by a bezel 304 of the shield 204, lending support to edges of the opening and providing a shield between a material of the body kit at the opening and heat radiating through the tail pipe. The shield 204 may be a shell formed from a rigid, durable material, such as aluminum, with a higher heat tolerance than the material of the body kit. The tail pipe and asymmetric outlet 202 may be formed from a similar or different, rigid and heat tolerant material, such as steel, depending on whether the asymmetric outlet 202 is continuously integrated with the tail pipe or formed of a separate piece, configured to be coupled to the downstream end of the tail pipe.

Furthermore, a cross-sectional area, e.g., along the y-x plane, of the asymmetric outlet 202 may be adapted to reduce deposition of exhaust contaminants, such as soot, onto a rear exterior surface of the vehicle while suppressing exhaust system noise. Thus in some examples, the geometry of the asymmetric outlet 202 may be configured to complement the shield 204 to provide a similar air distribution through both components. However, in other examples, the shapes of the asymmetric outlet 202 and the shield 204 may be chosen independent of one another and not configured to match.

An example of rear end 802 of a vehicle 800 is shown in FIG. 8 that includes a bezel 803 of a shield 804 framing an asymmetric outlet 806 of an exhaust tail pipe, e.g., a tail pipe 316 shown in FIGS. 2-7. The asymmetric outlet 806 may centered within an opening 808 of the shield 804 and the shield 804 may be nested in a slot 810 in a rear fascia 812 positioned below a rear bumper 814 of the vehicle 800. The slot 810 may have a shape that matches an outer geometry of the bezel 803 and the bezel 803, when positioned in the slot 810, may be recessed into the slot so that the bezel 803 is flush with the rear fascia 812 and the asymmetric outlet 806 does not protrude beyond a contour of the rear fascia 812.

The asymmetric outlet 202 may extend through an opening 206 of the shield 204, centered within the opening 206, as shown in FIG. 2. A geometry of the shield 204 may be configured according to a desired aesthetic or to dimensions of a region of the body kit to which the shield 204 is coupled. In FIG. 2, the shield 204 is depicted with a tongue 208 protruding away from the opening 206 along the x-axis at a first side 210 of the shield 204. The tongue 208 may be scooped, similar to a blade of a shovel, with a base wall 212 extending along the y-x plane that is rectangular in shape, positioned between and coupled to a top wall 214 and a bottom wall 216. When the shield 204 is oriented as shown in FIG. 2, the top wall 214 may be arranged at a top of the shield 204 and the bottom wall 216 arranged along a bottom of the shield 204, with respect to the y-axis. Portions of the top wall 214 and the bottom wall 216 extending along the base wall 212 are included in the tongue 208. The top wall 214 may extend across an entire width 218, measured along the x-axis, of the shield 204 parallel with the x-axis. The bottom wall 216 may extend parallel with the x-axis for at least a portion of the width 218 of the shield 204 and curve towards the top wall 214 to merge with the top wall 214 at a second side 220, the second side 220 opposite of the first side 210, of the shield 204.

As depicted in FIG. 3, the top wall 214 and the bottom wall 216 may slope in opposing directions, towards one another along the z-axis, from an intersection 302 of the bezel 304 of the shield 204 with a sleeve 306 of the shield 204 towards an outer edge 308 of the bezel 304. The bezel 304 may be formed from the top wall 214, bottom wall 216, and tongue 208 and may not protrude out of the opening, e.g., towards an exterior of the vehicle, in the body kit of the vehicle so that the bezel 304 does not interrupt a smooth profile of the exterior surface of the vehicle body kit. The sleeve 306 may be recessed relative to the opening in the body kit so that the outer edge 308 of the bezel 304 is flush with exterior surface of the body kit. In contrast to the sloping of the top wall 214 and the bottom wall 216 towards one another as the walls extend away from the sleeve 306 of the shield 204, the base wall 212 of the tongue 208 and a side wall 402 at the second side 220 of the shield 204 may instead slope away from one another, as shown in FIG. 4.

In the top view 400 of FIG. 4, the base wall 212 of the tongue 208 is planar while the side wall 402 is curved. The base wall 212 of the tongue 208 and the side wall 402 may extend from the intersection 302 to the outer edge 308 of the bezel 304 at an angle relative to the z-axis and in opposite directions. As a result, a first width 406 of the shield 204 at the outer edge 308 is wider than a second width 408 of the shield 204 at the intersection 302. A difference in width of the shield 204 between the outer edge 308 and the intersection 302 may be between 20-50% of the first width 406. The difference in width of the shield 204 at the outer edge 308 versus the intersection 302 corresponds to an increase in cross-sectional area, taken along a plane perpendicular to a central axis 501 of the tail pipe 316, the central axis 501 parallel with the z-axis. Furthermore, when viewed from above, along the y-axis, the outer edge 308 and the intersection 302 may be parallel, both angled with respect to the x-axis and z-axis. For example, the outer edge 308 and the intersection 302 may form an angle relative to the x-axis of 20 degrees or 30 degrees, or an angle between 10-40 degrees.

The sleeve 306 of the shield 204 extends away from the intersection 302 along a portion of an overall length 310 of the shield 204, the overall length 310 defined along the z-axis, as shown in FIG. 3. The sleeve 306 may be cylindrical, circumferentially surrounding the asymmetric outlet 202, and spaced away from the asymmetric outlet 202 around a circumference of the asymmetric outlet 202, as shown in FIG. 2. A first length 312 of the shield 204 at the second side 220 may be longer than a second length 314 of the shield 204 at the first side 210, the difference in length resulting at least in part by the angling of the intersection 302 and the outer edge 308 relative to x-axis and z-axis, as shown in FIG. 4 and described above.

It will be appreciated that the shield 204 is a non-limiting example and the dimensions of the shield 204 may be varied without departing from the scope of the present disclosure. For example, a relative height-to-width ratio, the height parallel with the y-axis and the width parallel with the x-axis, of the shield 204 may differ from the examples of FIGS. 2-4 and 8. A section of the shield 204 that extends along the x-axis, e.g., the tongue 208, may be longer or shorter than shown, relative to the height. However, regardless of variations in dimensions, an asymmetric geometry of the shield 204 may be maintained. In other words, the shield 204 is not symmetric about the y-z plane, enabling the shield 204 to accommodate a geometry of a rear bumper of a vehicle, as shown in FIG. 8.

In addition, the asymmetric shape of the shield 204 may be configured to match an asymmetry of an outlet plume of exhaust gas from an exhaust tail pipe outlet, such as the asymmetric outlet 202. A shape of the asymmetric outlet 202 may result in biasing the outflow of exhaust gas to towards one side of the asymmetric outlet 202 which may correspond to an elongated portion, along the x-axis, of the shield 204, such as the tongue 208. The matching of the bezel shape to the outlet plume shape reduces concentrated flow impingement on isolated areas of the shield 204 as well as noise arising from flow impingement. Furthermore, discoloration of the bezel due to contact with concentrated soot and high temperature exhaust gases from the outlet plume is minimized when the geometry of the shield 204 is adapted to accommodate asymmetric outlet plume formation.

In FIGS. 3 and 4, the asymmetric outlet 202 is shown continuous with the tail pipe 316, extending along a portion of the overall length 310 of the shield 204. When continuously integrated with the tail pipe 316, the asymmetric outlet 202 may be formed of a same piece as at least a portion of the tail pipe 316. As such, the asymmetric outlet 202 may be formed of a same, high heat tolerant material as the tail pipe, such as steel, for example. The asymmetric outlet 202 is shown without the shield 204 in FIGS. 5-7 from a first profile view 500, a perspective view 600, and a bottom view 700, respectively. Elements in FIGS. 5-7 in common with elements shown in FIGS. 2-4 are similarly numbered and will not be re-introduced for brevity. An asymmetry of the asymmetric outlet 202 may be defined as a lack of mirror-symmetry across the y-z plane bisecting the asymmetric outlet 202.

As depicted in FIG. 5, the asymmetric outlet 202 may have a height 502 equal to a height 504 of the tail pipe 316, the heights defined along the y-axis. However, a geometry of the tail pipe 316, upstream of the asymmetric outlet 202, may be symmetric while the asymmetric outlet 202 is not symmetric. A width 222 of the asymmetric outlet 202 may be wider than a width 224 of the tail pipe 316, measured along the x-axis as shown in FIG. 2, due to an arrangement of a first flare 226 and a second flare 228 at the asymmetric outlet 202. The first flare 226 and the second flare 228 may be continuous with a wall of the asymmetric outlet 202, e.g., integrated into the wall, and sharing a continuous inner surface 604 and a continuous outer surface 602, as shown in FIG. 6 with the portions of the asymmetric outlet 202 surrounding the first flare 226 and second flare 228. Thus air flowing through the asymmetric outlet 202 also flows through the first flare 226 and the second flare 228.

Returning to FIG. 2, the first flare 226 and the second flare 228 may each extend outwards and away from an inner passage 230 that extends through the asymmetric outlet 202 and the tail pipe 316 as well as away from the central axis 501. The first flare 226 extends along the x-axis, in a same direction as the extension of the tongue 208 of the shield 204 and the second flare 228 extends along the x-axis in an opposite direction from the first flare 226. A width 232 of the first flare 226 may be greater than a width 234 of the second flare 228, matching the geometry of the shield 204, e.g., to accommodate placement of the tongue 208 at the first side 210 of the shield 204. The width of the first flare 226 may be wider than the width 234 of the second flare 234 by 50%, in one example. In other examples, the difference in width may be between 20-70% of the width 232 of the first flare 226.

Additionally, as illustrated in FIG. 7, a first slope angle a of the first flare 226, outwards and away from the central axis 501 from a first end 508 to a second end 510, may differ from a second slope angle Φ of the second flare 228, also outwards from a first end 701 to a second end 704. The first slope angle a may be larger than the second slope angle Φ. In one example, the first slope angle α may be 30 degrees and the second slope angle Φ may be 15 degrees. In other examples, the first slope angle a and second slope angle Φ may vary but the first slope angle α may be maintained 10-20 degrees larger than the second slope angle Φ.

As depicted in the profile view 500 of FIG. 5, the first flare 226 extends along an overall length 506 of the asymmetric outlet 202, the overall length 506 defined along the z-axis. In other examples, the first flare 226 may extend along a portion of the overall length 506 of the asymmetric outlet 202, rather than the entire overall length 506. The first end of the first flare 226 merges seamlessly and continuously with a wall of the tail pipe 316 and the second end 510 is integrated into the outer edge 512 of the asymmetric outlet 202.

The first flare 226 may flare outwards, sloping linearly away from the central axis 501 of the asymmetric outlet 202 from the first end 508 to the second end 510, forming an increasingly protuberant bulge along the x-axis, as shown in FIGS. 6 and 7. The second flare 228 may similarly flare outwards linearly, away from the central axis 501 in an opposite direction from the first flare 226, from the first end 702 to the second end 704, as shown in FIG. 7. The first end 702 of the second flare 228 may merge continuously and seamlessly with the wall of the tail pipe 316 and the second end 704 may terminate at the outer edge 512 of the asymmetric outlet 202. The second flare 228 may protrude increasingly outwards and away from the inner passage 230 towards the second end 704 but may protrude to a lesser extent than the first flare 226 due to the smaller width 234 of the second flare 228 relative to the first flare 226.

A length 706 of the first flare 226 may be similar to the overall length 506 (as shown in FIG. 2) of the asymmetric outlet 202 and also similar to a length 708 of the second flare 228. In other examples, however, the lengths of the first flare 226 and the second flare 228 may differ from one another. For example, the first flare 226 may be longer than the second flare 228 or the second flare 228 may be longer than the first flare 226. Additionally, in some examples, the difference in widths between the first flare 226 and the second flare 228 may be reversed so that the second flare 228 is wider than the first flare 226 at the outer edge 512 of the asymmetric outlet 202.

The first flare 226 and the second flare 228 may be seamlessly integrated into the wall of the tail pipe 316, forming the smooth, continuous outer surface 602 and inner surface 604 between and including the tail pipe 316 and the asymmetric outlet 202, the outer surface 602 and inner surface 604 depicted in FIG. 6. A thickness 606 of the asymmetric outlet 202, defined as a distance between the outer surface 602 and the inner surface 604, may be uniform around a circumference of the asymmetric outlet 202. The first flare 226 and the second flare 228 may transition to an upper wall 608 of the asymmetric outlet 202 at a first set of bends 610 and to a lower wall 612 of the asymmetric outlet 202 at a second set of bends 614. The first set of bends 610 and the second set of bends 614 curve away from the central axis 501 while the upper wall 608, the lower wall 612, and central regions of the first flare 226 and the second flare 228 curve towards from the central axis 501. As such, the outer edge 512 of the asymmetric outlet 202 has a curving, meandering path when viewed along the z-axis, e.g., as shown in the vehicle rear view 200 of FIG. 2 and the perspective view 600 of FIG. 6.

The outer edge 512 may be angled with respect to the x-z plane, as shown in FIGS. 5 and 7. When viewed along the x-axis, e.g., in the profile view 500 of FIG. 5, the outer edge 512 has a planar, sloped geometry. The upper wall 608 has a length equal to the overall length 506 of the asymmetric outlet 202, defined as a distance between a point even with the first end 508 of the first flare 226 and the outer edge 512 of the asymmetric outlet 202. A length 514 of the lower wall 612 may be shorter than the length 506 of the upper wall 608. The lengths are shown in both FIGS. 5 and 7.

The length of the asymmetric outlet 202 may decrease linearly through portions of the circumference of the asymmetric outlet 202 from a central region of the upper wall 608 to a central region of the lower wall 612, e.g., along the outer edge 512 at the second end 510 of the first flare 226 and along the outer edge 512 at the second end 704 of the second flare 228. The changes in length of the asymmetric outlet 202 around the circumference of the asymmetric outlet 202 forms a slanted outer edge 512 that allows the outer edge 512 to accommodate an angled positioning of the asymmetric outlet 202 within the shield 204. For example, in some instances the central axis 501 of the asymmetric outlet 202 may not be parallel with the z-axis. The slant of the outer edge 512 maintains the outer edge 512 flush with the shield 204, e.g., the outer edge 512 does not protrude out of the shield 204 at any point. Thus, the slant of the outer edge 512 may vary depending on an orientation of the asymmetric outlet 202 within the shield 204. For example, when the asymmetric outlet 202 is aligned with the z-axis, the outer edge 512 may not be slanted and instead be perpendicular to a wall of the asymmetric outlet. However, if the asymmetric outlet is angled relative to the z-axis by 15 degrees, the outer edge 512 may be similarly slanted by 15 degrees.

In this way, an asymmetric, flared geometry of the asymmetric outlet 202 is provided. By configuring the asymmetric outlet 202 with a width that increases towards the outer edge 512 of the asymmetric outlet, as shown in FIG. 2, a cross-sectional area of the asymmetric outlet along the y-x plane may also increase towards the outer edge 512. For example, a conventional, circular and symmetric outlet may have a cross-sectional area at the outlet equal to a cross-section area of a tail pipe upstream of the outlet. In comparison, the cross-sectional area of the asymmetric outlet 202 at the outer edge 512 may be 10-25% greater than the cross-sectional area of the tail pipe 316.

The outward sloping of the first flare 226 and the second flare 228 along different angles, e.g., the first slope angle a and second slope angle Φ of FIG. 7, results in the increased cross-sectional area along the length 506 of the asymmetric outlet 202. While other shapes may allow a tail pipe outlet to gradually increase in cross-sectional area, such as a cone or funnel shape, or an outlet with more than two flared regions, the geometry of the asymmetric outlet 202 of FIGS. 2-7 allows high frequency air rush noise to be decreased while adding an aesthetic to the asymmetric outlet 202. The aesthetic of the asymmetric outlet 202 enables a matching of the shape of the asymmetric outlet 202 to contours of a rear fascia or side panel of the vehicle while facilitating flow expansions, diffusion, and velocity reduction.

The arrangement of the asymmetric outlet 202 within the shield 204 and spaced away from inner surfaces from shield 204 may allow the combination of the asymmetric outlet 202 and the shield 204 to utilize the Coandă effect to control a plume of exhaust gas emerging from the asymmetric outlet 202. In brief, the Coandă effect is a tendency of a fluid jet to adhere to and follow an adjacent surface. As the fluid jet flows along the adjacent surface, surrounding fluid is entrained, resulting in development of a lower pressure region along the adjacent surface, causing the fluid jet to deviate toward the region of lower pressure.

Furthermore, providing straight surfaces along the exhaust path in proximity to curved rear vehicle structures, such as rear fascia, may break up the exhaust flow, thereby shielding the exterior curved surfaces from soot accumulation. By providing shielding elements, e.g., the shield 204, inside of an exhaust opening, exhaust gases may be dragged by shearing forces along surfaces defined by the shielding elements and away from the curved exterior surfaces of the vehicle.

With respect to the positioning of the asymmetric outlet 202 to the shield 204, the asymmetric outlet 202, partially depicted in FIG. 4 by dashed outline 410, may be recessed within shield 204 so that the asymmetric outlet 202 extends along a portion of the overall length 310, from the sleeve 306 towards the outer edge 308 of the shield 204 but ending before the outer edge 308, e.g., the outer edge 512 of the asymmetric outlet 202 is not even with the outer edge 308 of the shield 204. The recessing of the asymmetric outlet 202 within the shield 204 allows exhaust gas flowing out of the asymmetric outlet 202 to come into contact with inner surface of the shield 204. As per the Coandă effect, at least a portion of the flow exiting from the first flare 226 of the asymmetric outlet 202 may flow along an inner surface of the tongue 208 of the shield 204, as indicated by arrow 412. Similarly, at least a portion of the flow exiting from the second flare 228 may flow along an inner surface of the side wall 402 of the shield 204, as indicated by arrow 402. Thus, the geometry of the asymmetric outlet 202 provides an initial shaping of the plume of exhaust gas, released into the shield 204 and the geometry of the shield 204 further shapes the plume of exhaust gas as the exhaust gas is directed to the surrounding atmosphere without following the outer contours of the vehicle.

Figure 9:
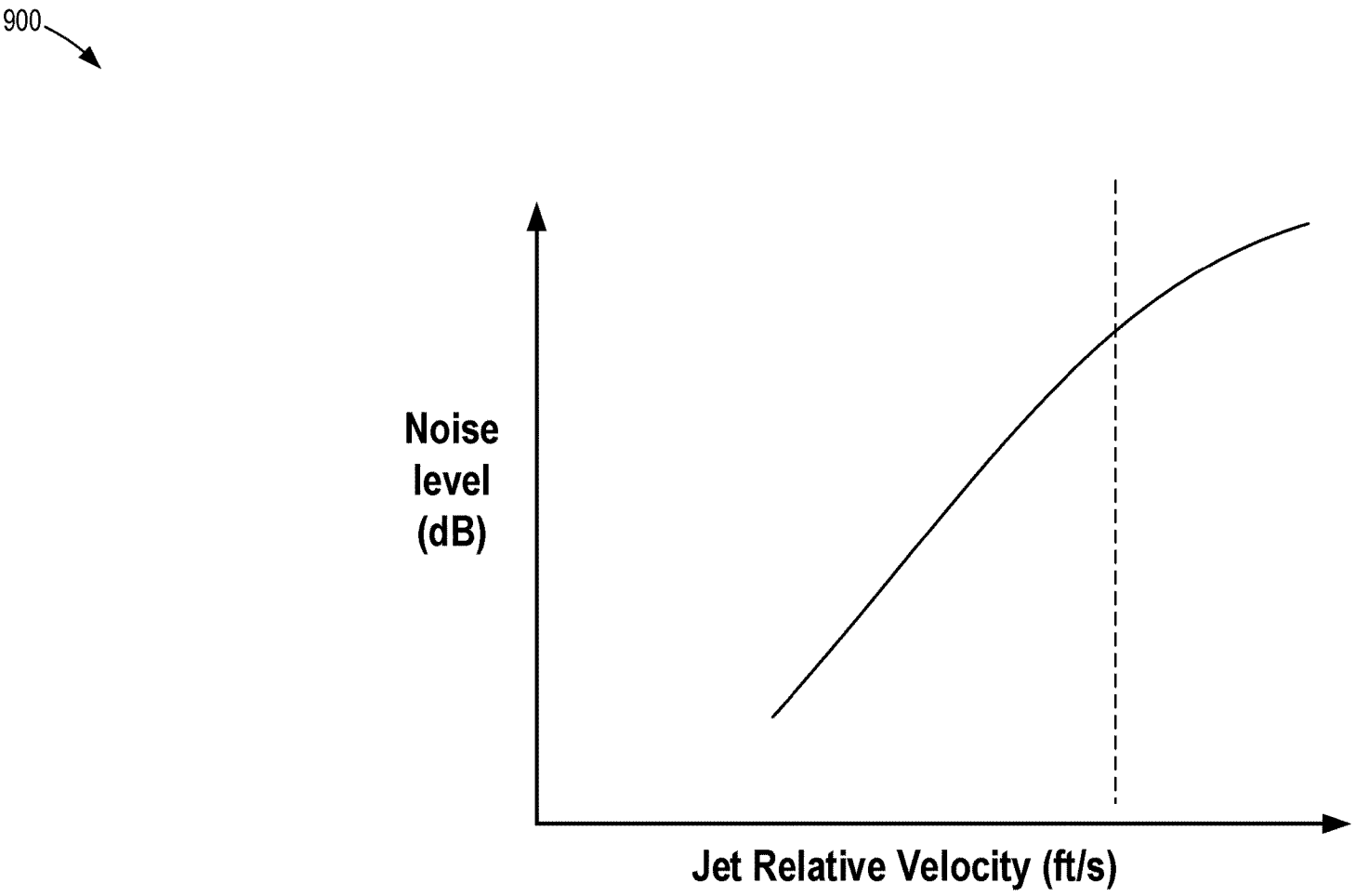
FIG. 9 shows an example plot depicting a relationship between noise level and a relative velocity of a jet.

The increase in cross-sectional area causes a decrease in flow velocity as exhaust gases travel through the tail pipe 316 and out of the asymmetric outlet 202, in a direction indicated by arrow 710 in FIG. 7. The decrease in flow velocity through the asymmetric outlet 202 may contribute to reduction of noises emanating from the tail pipe. As shown in FIG. 9, plot 900 depicts noise level in decibels (dB) as a function of velocity in feet per second (ft/s) for a jet. As velocity decreases, noise level also decreases, in a non-linear manner. At lower velocities, e.g., to the left of dashed line 902, a slope of plot 900 increases, indicating a more pronounced effect of velocity on noise as flow velocity is retarded.

Figure 11:
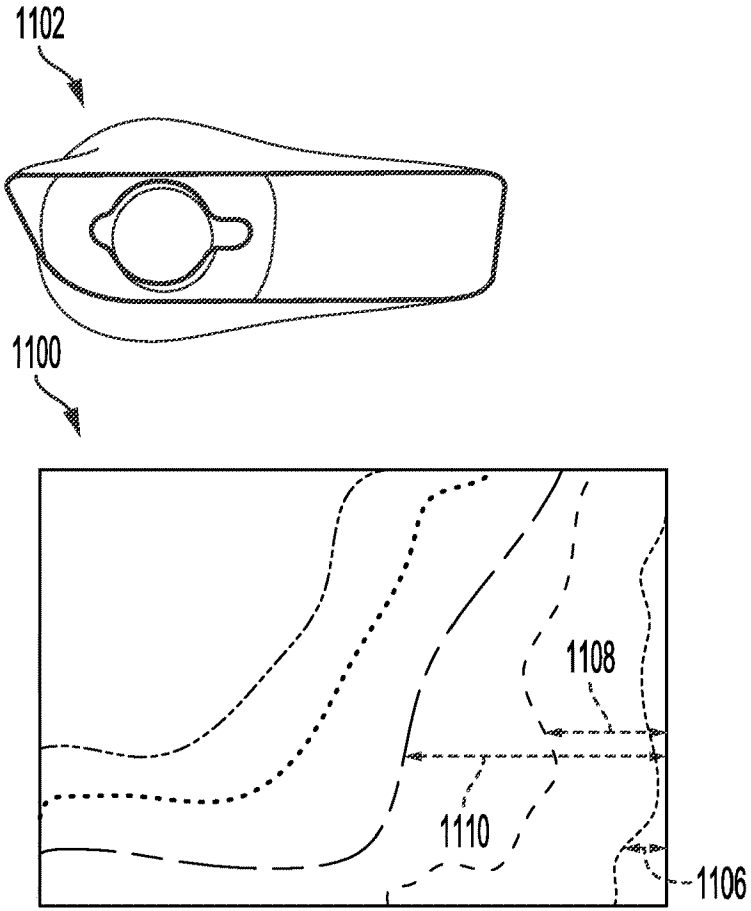
FIG. 11 shows a second contour plot illustrating sound contours for noise produced at an asymmetric tail pipe outlet.
Figure 10:
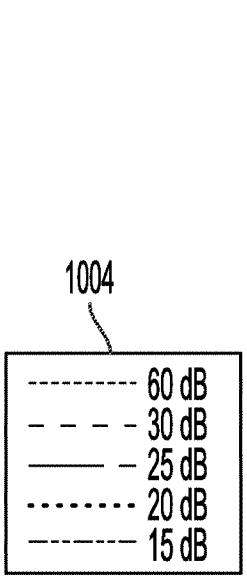
FIG. 10 shows a first contour plot illustrating sound contours for noise produced at a circular tail pipe outlet.
Figure 10:
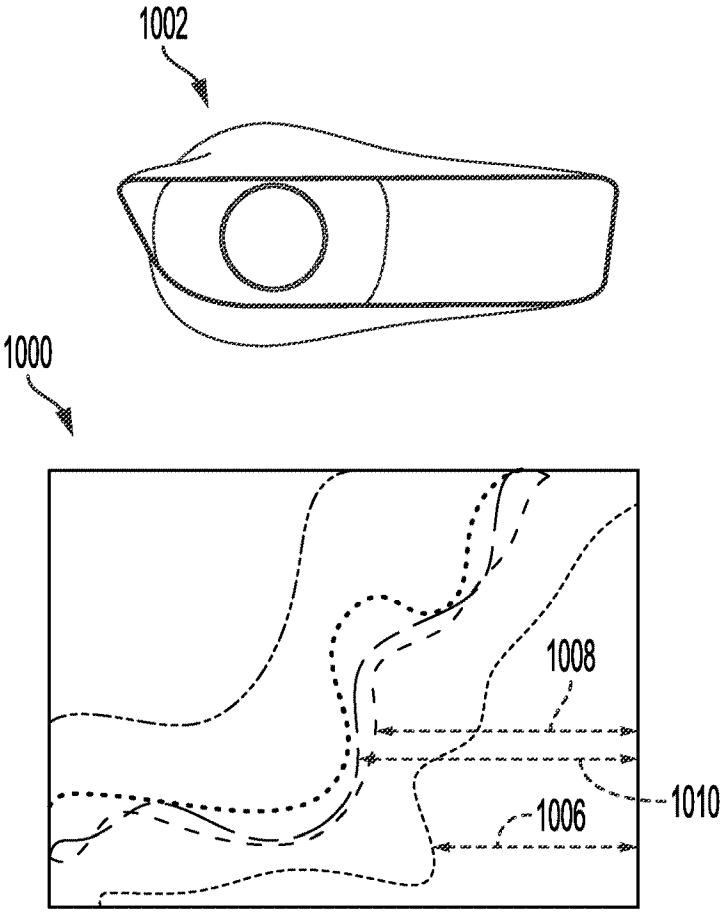

An effect of reduced flow velocity on acoustic emissions at an outlet of an exhaust tail pipe of a vehicle is shown in FIGS. 10 and 11. Contour plot 1000 is shown in FIG. 10 for a circular tail pipe outlet 1002. Plot 1000 comprises a first set of contours indicating sound measurements in dB which are denoted in legend 1004. The first set of contours of plot 1000 represents noise emission along a plane perpendicular to an outer edge of the circular outlet 1002, external to the outlet. Similarly, contour plot 1100 shown in FIG. 11 depicts a second set of contours, a decibel level of each contour of the second set of contours indicated in legend 1004, for an asymmetric outlet 1102 of an exhaust tail pipe. In one example, the asymmetric outlet 1102 may be the asymmetric outlet 202 of FIGS. 2-7. The second set of contours of contour plot 1100 represents noise emission along a plane perpendicular to an outer edge of the asymmetric outlet 1102, external to the asymmetric outlet 1102.

A distance 1006 between a 60 dB contour and the edge of the circular outlet 1002 in plot 1000 is greater than a distance 1106 between a 60 dB contour and the edge of the asymmetric outlet 1102 in plot 1100. A distance 1008 between a 30 dB contour and the edge of the circular outlet 1002 in plot 1000 may also be greater than a distance 1108 between a 30 dB contour and the edge of the asymmetric outlet 1102 in plot 1100. However, a distance 1010 between a 25 dB contour and the edge of the circular outlet 1002 in plot 1000 may be similar to a distance 1110 between a 25 dB contour and the edge of the asymmetric outlet 1102 in plot 1100. An increased cross-sectional area of the asymmetric outlet 1102 compared to the circular outlet 1002 may result in more rapid decay of high decibel sound waves, thereby attenuating high amplitude acoustic waves efficiently and reducing detection of exhaust gas noises in the exhaust tail pipe by passengers occupying the vehicle as well as observers nearby and outside of the vehicle.

An asymmetric outlet, such as the asymmetric outlet 202 of FIGS. 2-7 and 806 of FIG. 8, may be integrated into a downstream end of an exhaust tail pipe to effect sound attenuation in an exhaust system. The asymmetric outlet may be implemented by forming the tail pipe, e.g., by molding or casting, etc., with the asymmetric outlet as a single continuous unit. Alternatively, the tail pipe may be formed separately from the asymmetric outlet and the components coupled together by, for example, welding. By equipping the tail pipe with an outlet that increases in cross-sectional area asymmetrically, use of a conventional device, such as muffler, with a plurality of sound-absorbing layers may be precluded, reducing a weight of the exhaust system. In other words, the exhaust tail pipe, with the asymmetric outlet, may provide a path of gas flow between an aftertreatment device and an outer edge of the asymmetric outlet without a muffler present. However, in some examples, the asymmetric outlet may be dispensed in conjunction with the muffler to provide additional sound attenuation.

In this way, an asymmetric tail pipe outlet may reduce undesirable noise produced during vehicle operation. A widening of the asymmetric tail pipe outlet towards an outer edge of the outlet may retard exhaust gas flow as exhaust gases travel through an exhaust system of the vehicle, exiting the system at the asymmetric tail pipe outlet. Reducing gas flow velocity may suppress emanation of high decibel noise from the asymmetric tail pipe outlet, thereby providing a more enjoyable experience for vehicle passengers and individuals external to the vehicle. The asymmetric tail pipe outlet may be readily added to an exhaust tail pipe during manufacturing by molding/casting the tail pipe with a flared, asymmetric outlet. Furthermore, dampening exhaust system noise by configuring the tail pipe outlet with the flared, asymmetric geometry precludes use of acoustically absorbing materials in the exhaust system. Thus, implementation of the asymmetric tail pipe outlet does not add weight to the vehicle, thereby maintaining a fuel efficiency of the vehicle.

A technical effect of equipping an exhaust system of a vehicle with an asymmetric tail pipe outlet is that flow velocity of exhaust gases is decreased at the outlet and high decibel noise is attenuated as a result.

In one embodiment, an asymmetric exhaust tail pipe outlet includes a first flared extension, sloping outwards and away from a central axis of the exhaust tail pipe outlet from a first end to a second end of the outlet, sharing an inner surface with surrounding portions of the exhaust tail pipe outlet, and a second flared extension, opposite of the first flared extension, sloping outwards and away from the central axis from the first end to the second end to a lesser extent than the first flared extension and also sharing the inner surface of the exhaust tail pipe outlet. In a first example of the tail pipe outlet, the first end is upstream of the second end and the first end is continuously coupled to a tail pipe arranged upstream of the first end of the outlet. A second example of the tail pipe outlet optionally includes the first examples, and further includes wherein the tail pipe, upstream of the first end of the outlet is symmetric and the outlet, downstream of the first end, is asymmetric across a plane aligned with the central axis and bisecting the outlet between the first flared extension and the second flared extension. A third example of the tail pipe outlet optionally includes one or more of the first and second examples, and further includes, wherein the first flared extension and the second flared extension both curve outwards and away from the central axis along a plane perpendicular to the central axis as the first flared extension and second flared extension slope outwards along the central axis and wherein the first flare extension slopes outward at a greater angle than the second flared extension. A fourth example of the tail pipe outlet optionally includes one or more of the first through third examples, and further includes, wherein the first flared extension and the second flared extension both couple to an upper wall and a lower wall of the outlet through curved regions that curve inwards, towards the central axis. A fifth example of the tail pipe outlet optionally includes one or more of the first through fourth examples, and further includes, wherein the upper wall and the lower wall each have a curvature that is similar to a curvature of the tail pipe and each of the upper wall and the lower wall merge with a wall of the tail pipe seamlessly and continuously. A sixth example of the tail pipe outlet optionally includes one or more of the first through fifth examples, and further includes, wherein a cross-sectional area of the outlet, along a plane perpendicular to the central axis, increases from the first end to the second end of the outlet. A seventh example of the tail pipe outlet optionally includes one or more of the first through sixth examples, and further includes, wherein a width of the outlet, along a plane aligned with the central axis and bisecting the first flared extension and the second flared extension, increases from the first end to the second end of the outlet. An eighth example of the tail pipe outlet optionally includes one or more of the first through seventh examples, and further includes, wherein a height of the outlet, along a plane aligned with the central axis and perpendicular to the width of the outlet, is uniform from the first end to the second end of the outlet. A ninth example of the tail pipe outlet optionally includes one or more of the first through eighth examples, and further includes, wherein the second end of the outlet is angled relative to a plane perpendicular to the central axis.

In another embodiment, an exhaust assembly includes a tail pipe, a flared, asymmetric outlet, continuous with the tail pipe and increasing in area from a first, upstream end to a second, downstream end of the outlet, the area perpendicular to a central axis of the tail pipe, and an enclosure at least partially circumferentially surrounding the outlet and having at least one section flaring outward, away from the central axis of the tail pipe. In a first example of the assembly, the outlet has a first extension protruding from a first side of the outlet that slopes away from the central axis from the first end to the second end of the outlet and wherein the first extension shares an inner surface with the outlet and is configured to flow gas therethrough. A second example of the assembly optionally includes the first example, and further includes, wherein the outlet has a second extension protruding from a second side of the outlet, opposite of the first side, the second extension sloping away from the central axis from the first end to the second end of the outlet in an opposite direction from the first extension and protruding away from the central axis at the second end a smaller distance than the first extension at the second end and wherein the second extensions shares an inner surface with the outlet and is configured to flow gas therethrough. A third example of the assembly optionally includes one or more of the first and second examples, and further includes, wherein the outlet is arranged within an opening of the enclosure so that a wall of the outlet is spaced away from surfaces of the enclosure. A fourth example of the assembly optionally includes one or more of the first through third examples, and further includes, wherein the first extension of the outlet protrudes away from the central axis in a same direction as the at least one outward flaring section of the enclosure. A fifth example of the assembly optionally includes one or more of the first through fourth examples, and further includes, wherein the enclosure has a cylindrical portion coupled to and upstream of a frame of the enclosure, the frame having an asymmetrical geometry and configured to couple to an outer panel of a vehicle. A sixth example of the assembly optionally includes one or more of the first through fifth examples, and further includes, wherein a cross-sectional area of the frame of the enclosure, the cross-sectional area perpendicular to the central axis, increases from a merging point of the cylindrical portion and the frame to an outer, front-facing edge of the frame.

In another embodiment, an exhaust system includes an exhaust passage, configured to flow exhaust gases, with an asymmetric outlet, the asymmetric outlet including a first flared side and a second flared side, the second side opposite of the first side, and a housing at least partially circumferentially surrounding the asymmetric outlet with one section flaring in a direction of the first flared side of the asymmetric outlet and configured to couple to an outer panel of the vehicle. In a first example of the system, the asymmetric outlet of the exhaust passage is integrated into the exhaust passage as a single, continuous unit. A second example of the system optionally includes the first example and further includes, wherein a cross-sectional area of the outlet is smaller at an upstream end than a downstream end of the outlet and the increase in cross-sectional area is configured to reduce a flow velocity of exhaust gases.

In another representation, a vehicle includes an exhaust system including a tail pipe terminating with an asymmetric outlet, the asymmetric outlet increasing in width from an upstream end to a downstream end, configured to reduce flow velocity of exhaust gases flowing through the exhaust system, and an outer panel with an opening framed by a bezel, the bezel circumferentially surrounding the asymmetric tail pipe and having a geometry matching a geometry of the asymmetric outlet. In a first example of the exhaust system, the asymmetric outlet is formed of a separate piece from the tail pipe and configured to be coupled to a downstream end of the tail pipe.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An asymmetric exhaust tail pipe outlet, comprising:

a first flared extension, sloping outwards and away from an inner passage and a central axis of the asymmetric exhaust tail pipe outlet from a first end to a second end of the asymmetric exhaust tail pipe outlet, sharing an inner surface with surrounding portions of the exhaust tail pipe outlet; and a second flared extension, opposite of the first flared extension, sloping outwards and away from the inner passage and the central axis from the first end to the second end to a lesser extent than the first flared extension and also sharing the inner surface of the asymmetric exhaust tail pipe outlet, wherein the inner passage extends through the asymmetric exhaust tail pipe outlet and through the asymmetric exhaust tail pipe outlet from the first end to the second end.

2. The outlet of claim 1, wherein the first end is upstream of the second end and the first end is continuously coupled to a tail pipe arranged upstream of the first end of the outlet.

3. The outlet of claim 2, wherein the tail pipe, upstream of the first end of the outlet is symmetric and the outlet, downstream of the first end, is asymmetric across a plane aligned with the central axis and bisecting the outlet between the first flared extension and the second flared extension.

4. The outlet of claim 3, wherein the first flared extension and the second flared extension both curve outwards and away from the central axis along a plane perpendicular to the central axis as the first flared extension and second flared extension slope outwards along the central axis and wherein the first flare extension slopes outward at a greater angle than the second flared extension.

5. The outlet of claim 4, wherein the first flared extension and the second flared extension both couple to an upper wall and a lower wall of the outlet through curved regions that curve inwards, towards the central axis.

6. The outlet of claim 5, wherein the upper wall and the lower wall each have a curvature that is similar to a curvature of the tail pipe and each of the upper wall and the lower wall merge with a wall of the tail pipe seamlessly and continuously.

7. The outlet of claim 1, wherein a cross-sectional area of the outlet, along a plane perpendicular to the central axis, increases from the first end to the second end of the outlet.

8. The outlet of claim 1, wherein a width of the outlet, along a plane aligned with the central axis and bisecting the first flared extension and the second flared extension, increases from the first end to the second end of the outlet.

9. The outlet of claim 8, wherein a height of the outlet, along a plane aligned with the central axis and perpendicular to the width of the outlet, is uniform from the first end to the second end of the outlet.

10. The outlet of claim 1, wherein the second end of the outlet is angled relative to a plane perpendicular to the central axis.

11. An exhaust assembly, comprising:

a tail pipe;

a flared, asymmetric outlet, continuous with the tail pipe and increasing in a cross-sectional area from a first, upstream end to a second, downstream end of the flared, asymmetric outlet, the cross-sectional area perpendicular to a central axis of the tail pipe; and an enclosure at least partially circumferentially surrounding the flared, asymmetric outlet and having at least one section flaring outward, away from the central axis of the tail pipe, wherein the cross-sectional area at the first, upstream end includes the cross-sectional area of an inner passage, the inner passage extending through the tail pipe and through the flared, asymmetric outlet from the first, upstream end to the second, downstream end.

12. The exhaust assembly of claim 11, wherein the outlet has a first extension protruding from a first side of the outlet that slopes away from the central axis from the first, upstream end to the second, downstream end of the outlet and wherein the first extension shares a first inner surface with the outlet and is configured to flow gas therethrough.

13. The exhaust assembly of claim 12, wherein the outlet has a second extension protruding from a second side of the outlet, opposite of the first side, the second extension sloping away from the central axis from the first, upstream end to the second, downstream end of the outlet in an opposite direction from the first extension and protruding away from the central axis at the second end a smaller distance than the first extension at the second end and wherein the second extensions shares a second inner surface with the outlet and is configured to flow gas therethrough.

14. The exhaust assembly of claim 13, wherein the outlet is arranged within an opening of the enclosure so that a wall of the outlet is spaced away from surfaces of the enclosure.

15. The exhaust assembly of claim 14, wherein the first extension of the outlet protrudes away from the central axis in a same direction as the at least one outward flaring section of the enclosure.

16. The exhaust assembly of claim 11, wherein the enclosure has a cylindrical portion coupled to and upstream of a frame of the enclosure, the frame having an asymmetrical geometry and configured to couple to an outer panel of a vehicle.

17. The exhaust assembly of claim 16, wherein a cross-sectional area of the frame of the enclosure, the cross-sectional area perpendicular to the central axis, increases from a merging point of the cylindrical portion and the frame to an outer, front-facing edge of the frame.

18. An exhaust system for a vehicle, comprising:

an exhaust passage, configured to flow exhaust gases, with an asymmetric outlet, the asymmetric outlet including a first flared side and a second flared side, the second flared side opposite of the first flared side; and a housing at least partially circumferentially surrounding the asymmetric outlet with one section flaring in a direction of the first flared side of the asymmetric outlet and configured to couple to an outer panel of the vehicle, wherein the first flared side and the second flared side protrude increasingly outwards and away from an inner passage and a central axis, the inner passage and the central axis extending through the exhaust passage and the asymmetric outlet.

19. The exhaust system of claim 18, wherein the asymmetric outlet of the exhaust passage is integrated into the exhaust passage as a single, continuous unit.

20. The exhaust system of claim 19, wherein a cross-sectional area of the asymmetric outlet is smaller at an upstream end than a downstream end of the asymmetric outlet and an increase in the cross-sectional area from the upstream end to the downstream end is configured to reduce a flow velocity of the exhaust gases.

* * * * *